United States Patent [19]

Larson

[11] Patent Number: 4,627,782

[45] Date of Patent: Dec. 9, 1986

[54] GRAIN STORAGE AND TRANSPORTATION CONTAINER

[76] Inventor: Gordon C. Larson, 511 4th Ave. Southeast, Minneapolis, Minn. 55414

[21] Appl. No.: 676,541

[22] Filed: Nov. 30, 1984

Related U.S. Application Data

[63] Continuation of Ser. No. 444,372, Nov. 26, 1982, abandoned.

[51] Int. Cl.[4] ..... B60P 1/04

[52] U.S. Cl. ..... 414/491; 298/12

[58] Field of Search ..... 414/420, 421, 491, 492, 414/786, 498–500; 126/343.5 A, 343.5 R; 222/165, 502, 503, 164, 166, 195; 52/192; 298/1 H, 12, 14, 24

[56] References Cited

U.S. PATENT DOCUMENTS

| | | | |
|---|---|---|---|
| 770,097 | 8/1903 | McMahon | 222/503 |
| 2,070,152 | 2/1937 | Bennett | 222/503 X |
| 2,354,337 | 7/1944 | Smith | 414/500 X |
| 3,138,276 | 6/1964 | Allen et al. | 414/491 |
| 3,144,149 | 8/1964 | Dempster et al. | 414/491 |
| 3,171,405 | 3/1965 | Miller | 126/343.5 R |
| 3,526,331 | 9/1970 | Marshall et al. | 414/491 |
| 3,738,516 | 6/1973 | Wells | 414/421 X |
| 4,343,416 | 8/1982 | Etheredge et al. | 222/165 X |

FOREIGN PATENT DOCUMENTS

| | | | |
|---|---|---|---|
| 493175 | 5/1950 | France | 222/166 |

*Primary Examiner*—Joseph E. Valenza
*Assistant Examiner*—David A. Bucci
*Attorney, Agent, or Firm*—John W. Adams

[57] ABSTRACT

A container for storing and transporting grains having rigid side and end walls defining a generally rectangular or square cross-sectional shape, wherein the bottom corner is truncated to form a generally flat supporting base which is formed by a pair of hopper doors which provide the base panel when closed, but can be opened to discharge the contents from the container having a covered filler opening in the top, the container being provided with perforated drying tubes extending therewithin and a wheeled transport unit for receiving the container thereon and tilting the container into position where one of the hopper sides forms the bottom during transportation and permitting the container to be readily moved from one location to another.

4 Claims, 4 Drawing Figures

GRAIN STORAGE AND TRANSPORTATION CONTAINER

This is a continuation of application Ser. No. 444,372, filed Nov. 26, 1982, now abandoned.

BACKGROUND OF THE INVENTION

In the past, grains have had to be initially loaded into trucks in the field and delivered to large storage bins on the farm site for storage until marketing. This requires initial handling in the loading of the truck, a second handling in unloading the truck, a third handling in loading the bins, a fourth handling for unloading the bins and loading the grain back in the trucks, and a fifth handling at the country elevator site at the time the grain is sold by the farmer. The present invention permits the grain to be loaded once in the field, into the storage box and the storage box then transported to a suitable storage location on the farm site where the grain is stored until it is taken to market in the same storage box, thus eliminating most of the handling steps and thus, obviously reduces damage to the grain. Suitable means for drying the grain while confined within the box may be provided such as the perforated hollow tubes extending thereacross through which hot drying air can be injected through the grain without removing the grain from the box.

SUMMARY OF THE INVENTION

The invention consists in a generally cube shaped box having one corner thereof truncated to form sloping hopper sides and a box bottom, the bottom having normally closed hopper doors which form the supporting bottom for the box when closed, but which can be opened to discharge the contents of the box for dumping, the box being particularly easily loaded onto a pivoted sloping frame which matches the slope of one of the hopper side panels to permit the frame to be positioned thereunder with means for relasably connecting the box to the mounting frame and elevating the box thereon into transporting position for transporting the same from one location to another, said box being provided with a plurality of perforated air discharge tubes extending thereacross for introducing a flow of drying air through the grain confined within the container to dry the grain without removing it from the container and maintain optimum moisture content therein during storage in the container.

DETAILED DESCRIPTION OF THE PREFERRED EMBODIMENT

Figure 1:
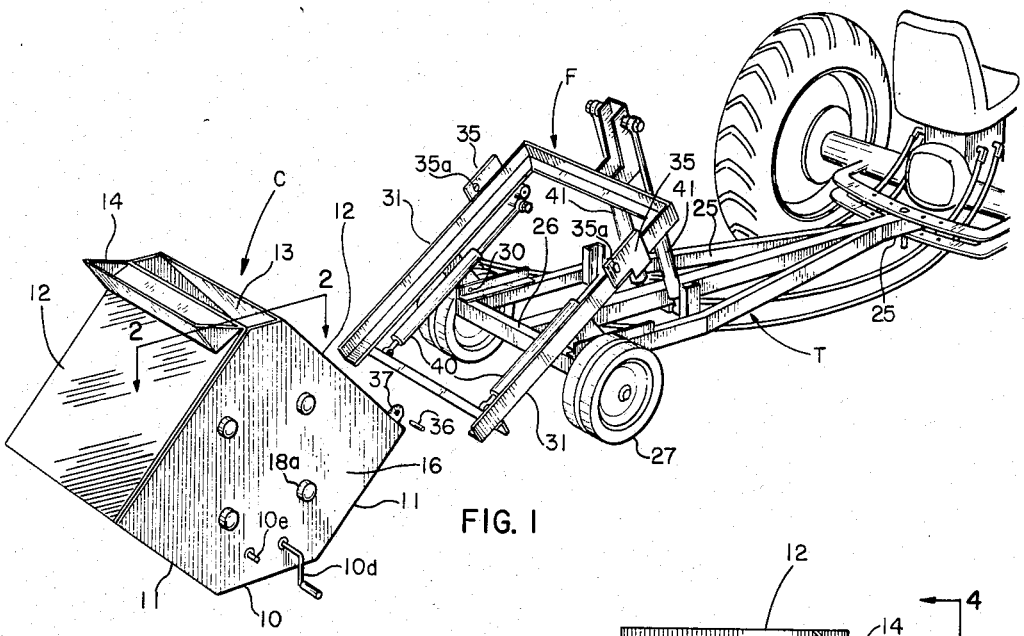
FIG. 1 is a perspective view of the container embodying this invention with a wheeled trailer unit about to be connected thereto for transporting the same.

As shown in the accompanying drawings, this invention provides a grain container unit C which is in the form of a cube having one edge thereof truncated to form a bottom 10. Sides 11 slope upwardly from the bottom at approximately 45° and the upper side walls 12 are rigidly connected to the upper ends of the sloping sides 11 and form upwardly converging top panels which are slightly truncated at the upper ends thereof to form an opening 13 through which grain can be introduced into the container. A cover 14 is hinged to the top of one of the sides 12. End panels 16 are provided to complete the generally cube-shaped enclosure.

A plurality of perforated air discharge cross tubes 18 are rigidly mounted in the ends 16 and extend across the container between said ends 16 to provide rigid cross bracing within the container unit. The ends of the tubes are normally closed but at least one end is provided with a removable cap **18*a*** which permits a hot air supply tube (not shown) to be connected to deliver hot drying air through the grain being stored in the unit C, thus providing a combination storage container and grain drier.

The truncated bottom of the container unit C is provided with a discharge opening which is normally closed by a pair of hopper doors **10*a* to which toothed arcuate segments 10*b* are fixed at the respective ends of the doors. The segments are mounted for movement within the container adjacent to the respective ends 16 and mesh with toothed pinion gears 10*c* to which crank 10*d* can be connected for turning the same to open and close the doors 10*a*. A cross shaft 10*e* connects opposed pinions 10*c***. The doors may be overlapped along the center line of the opening to provide a seal when closed.

A suitable container pick up and transporting vehicle is provided such as the trailer T illustrated, which has a pick up and carriage frame F pivotally mounted at the rear end thereof with the pivot points located substantially over the axle of the trailer T. The trailer T is provided with a rigid frame assembly 25 which has a hitch at the forward end thereof. An axle 26 is mounted at the rear end of the frame 25 and has wheels 27 journaled on the ends thereof. A pair of pivot pins 30 connect an intermediate portion of the frame F to the rear portion of the frame 25 above the axis of the axle 26 and in substantial alignment therewith. The pivoted frame F has suitable channel members or rails 31 along the sides thereof to form a container-receiving channel and bed therebetween. Suitable slides 35 are slidably mounted on the rails 31 and are provided for suitable releasable connection with the container unit C as by a pair of removable connector pins 36 inserted through holes **35*a* formed in the forward ends of slides 35 and in brackets 37 fixed to container C. A pair of hydraulic cylinders 40 connect the frame unit F to the slides 35 as shown and provide the power for moving the slides forward and back on the rails 31. A second pair of cylinders 41 are connected between an intermediate portion of the trailer frame 25** and the foward end of the pick up and carriage frame F to raise and lower the front end of said frame F to facilitate picking up, transporting, and dumping the container unit C.

Figure 2:
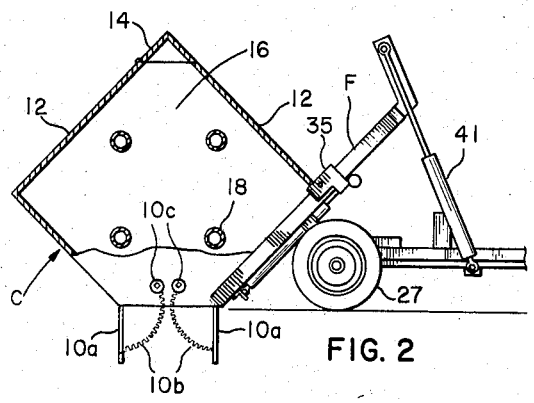
FIG. 2 is a side elevational view of the trailer connected to the storage unit with the hopper doors shown in open, dumping position.
Figure 3:
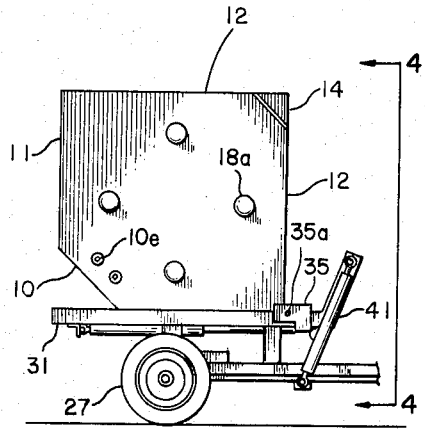
FIG. 3 is a side elevational view of the container mounted on the trailer in transporting position.
Figure 4:
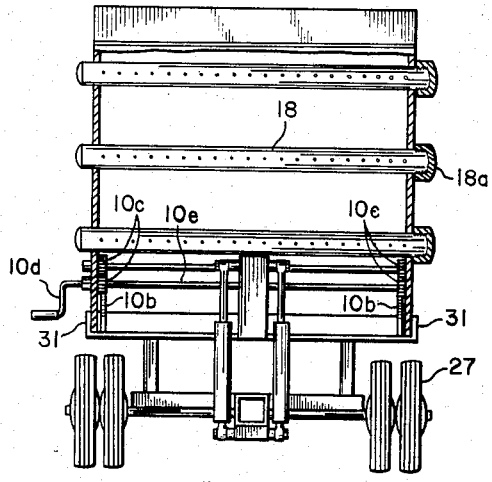
FIG. 4 is a front elevational view taken substantially along the line 4—4 of FIG. 3 with portions broken away.

As best shown in FIG. 1, the storage container unit C may be placed outside in any convenient location for storage on the farm site until the proper time for transportation to the market place. When the grain is initially loaded into the container through the top opening 13, it may be attached to a farm tractor with the hydraulic system of the tractor connected with the hydraulic cylinders 40 and 41 for controlled actuation thereof. The grain may be introduced into the container in the field where it is being harvested and when filled, the next container is merely moved into filling position adjacent to the harvesting machine (not shown). As previously stated, hot drying air may be introduced into the grain mass confined within the container unit C so that the grain may be dried and kept at the optimum moisture content after harvesting and during storage. When the box is to be transported to another location, the trailer unit T is backed into pick up position with the pick up and carriage frame tilted upwardly to engage the sloping side 11 with the attachment pins 36 inserted through the holes 35*a* of slides 35 and the holes in brackets 37. The cylinders 40 are in retracted position for initial pick up and the cylinders 41 are in extended position. When the box has been connected to the slides 35, the cylinders 40 are extended and the cylinders 41 are retracted. This may be done simultaneously or successively. The hydraulic system of the tractor is normally used for actuating the cylinders 40 and 41. When the frame has been lowered into horizontal transporting position as shown in FIG. 3, the box may be then transported to the market place or to any other desired location. At the market place the container may be dumped by tilting the frame F into the position shown in FIG. 2 and the hopper doors 10*a* swung downwardly into open position as illustrated. This discharges the grain into a conventional elevator hopper (not shown).

It will be apparent that the combined container, drier and transporting unit has been provided which completely eliminates multiple handling of the grain which as is presently required. This not only prevents the expense of the multiple handling, it also eliminates the possibility of damaging the grain.

What is claimed is:

1. A storing and transporting container particularly adapted for use with grains and comprising, a rigid container unit having a rigid wall portions defining a grain storage chamber therewithin and having a generally flat bottom portion with a discharge opening therethrough, said flat bottom providing a flat surface for supporting engagement with underlying supporting means, openable flat hopper doors normally closing the discharge opening, certain of said side wall portions sloping downwardly toward the bottom discharge opening to direct the grain to said opening during the discharging operation, said container having a filler opening in the upper portion thereof with a removable cover normally closing said filler opening, means for connecting the upper portions of the sloping side wall portions to a wheeled vehicle for transporting the same from one location to another, and hollow perforated tube means extending across from one side wall to the other in fixed relation to both of said side walls and having sufficient strength to provide structural reinforcement to the container unit.

2. A combination of a storage and transporting grain container and a wheeled transporting vehicle, said container comprising, rigid wall portions defining the grain storage chamber therewithin and having a generally flat bottom portion with a discharge opening therethrough, openable closure elements normally closing the discharge opening, certain of said side wall portions having generally flat, downwardly sloping panels for guiding the grain being discharged down through the discharge opening, said container having a filler opening in the upper portion thereof with a removable cover, the transporting vehicle comprising a rigid frame structure, wheels journaled on said frame structure for supporting the same during transportation, a pick up and carriage frame pivotally mounted to the rear portion of said wheeled vehicle frame, means for tilting said pick up and carriage frame to an angle substantially equal to the angle of slope of the downwardly sloping panels when the container is resting on its flat bottom portion to permit the frame to be inserted under one of said sloping bottom panels for initial non-sliding mating engagement therewith, whereby the engaged sloping bottom panel becomes the transporting base for the container on the carriage frame, means for anchoring the container to the pivoted pick up and carriage frame, and means for tilting the carriage frame with the container thereon down into horizontal transporting position on said wheeled vehicle with the carriage engaging sloping panel forming the container base during transport.

3. The combination set forth in claim 2 and means for moving the container forwardly on said pick up and carriage frame after connection therewith.

4. The structure set forth in claim 3 and a pair of slide elements mounted on the sides of said pick up and carriage frame for removable connection with said container, and said means for moving the container forwardly comprising hydraulic cylinder means connected with said slide elements.

* * * * *